US005241818A

United States Patent [19]

Shekleton et al.

[11] Patent Number: 5,241,818

[45] Date of Patent: Sep. 7, 1993

[54] FUEL INJECTOR FOR A GAS TURBINE ENGINE

[75] Inventors: Jack R. Shekleton, San Diego; Robert W. Smith, Lakeside, both of Calif.

[73] Assignee: Sundstrand Corporation, Rockford, Ill.

[21] Appl. No.: 789,276

[22] Filed: Nov. 8, 1991

Related U.S. Application Data

[63] Continuation-in-part of Ser. No. 379,548, Jul. 13, 1989, Pat. No. 5,063,745.

[51] Int. Cl.[5] ..... F23R 3/32

[52] U.S. Cl. ..... 60/39.36; 60/738; 60/743

[58] Field of Search ..... 60/39.36, 39.37, 760, 60/738, 743; 239/500, 524; 431/159; 123/531

[56] References Cited

U.S. PATENT DOCUMENTS

| | | | |
|---|---|---|---|
| 517,310 | 3/1894 | Taylor | 239/500 |
| 2,967,394 | 1/1961 | Jensen . | |
| 3,088,279 | 5/1963 | Diedrich | 60/39.36 |
| 3,353,351 | 11/1967 | Bill et al. | 60/743 |
| 3,355,884 | 12/1967 | Poucher et al. | 60/743 |
| 3,613,360 | 10/1971 | Howes | 60/760 |
| 4,967,562 | 11/1990 | Shekleton | 60/738 |
| 4,967,563 | 11/1990 | Shekleton | 60/743 |

*Primary Examiner*—Richard A. Bertsch
*Assistant Examiner*—Timothy S. Thorpe
*Attorney, Agent, or Firm*—Wood, Phillips, Van Santen, Hoffman & Ertel

[57] ABSTRACT

Difficulties with fuel atomization at low fuel flow rates in gas turbine fuel injection systems may be overcome by use of an impingement injector (52) including a cylindrical orifice (64, 94, 114) that is smooth, straight and uninterrupted by burrs or other disturbances having an exit opening (68, 96, 118) transverse to the axis of the orifice (64, 94, 114) and facing an impingement surface (72, 101, 126) that is planar and spaced from the exit opening (68, 96, 118).

10 Claims, 2 Drawing Sheets

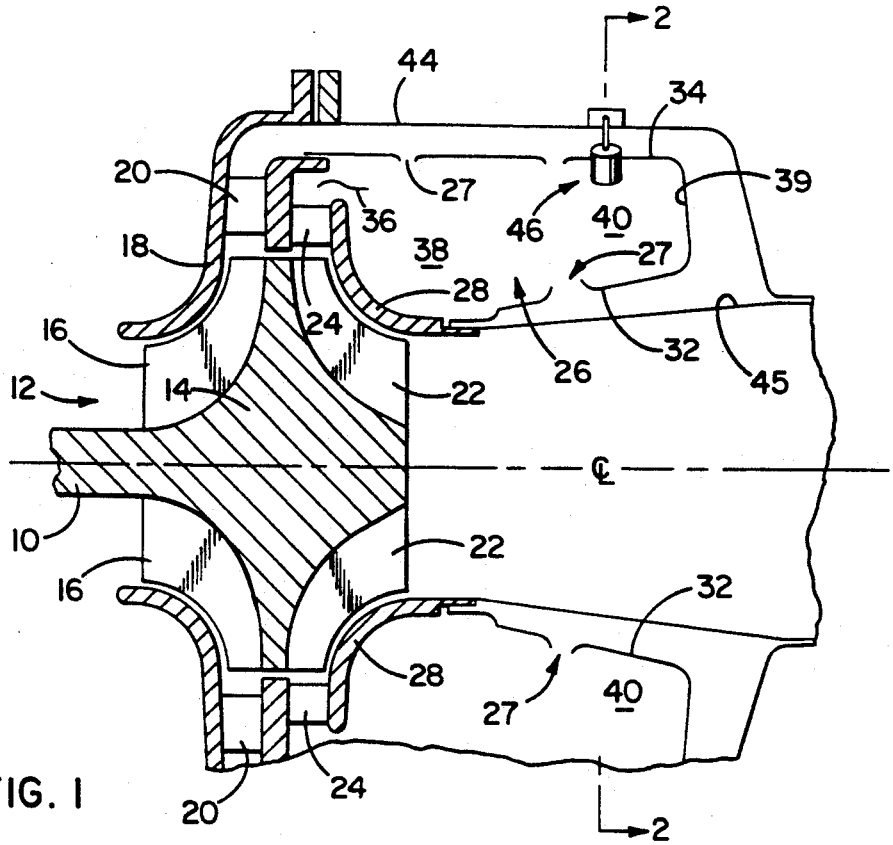
FIG. 1
FIG. 2
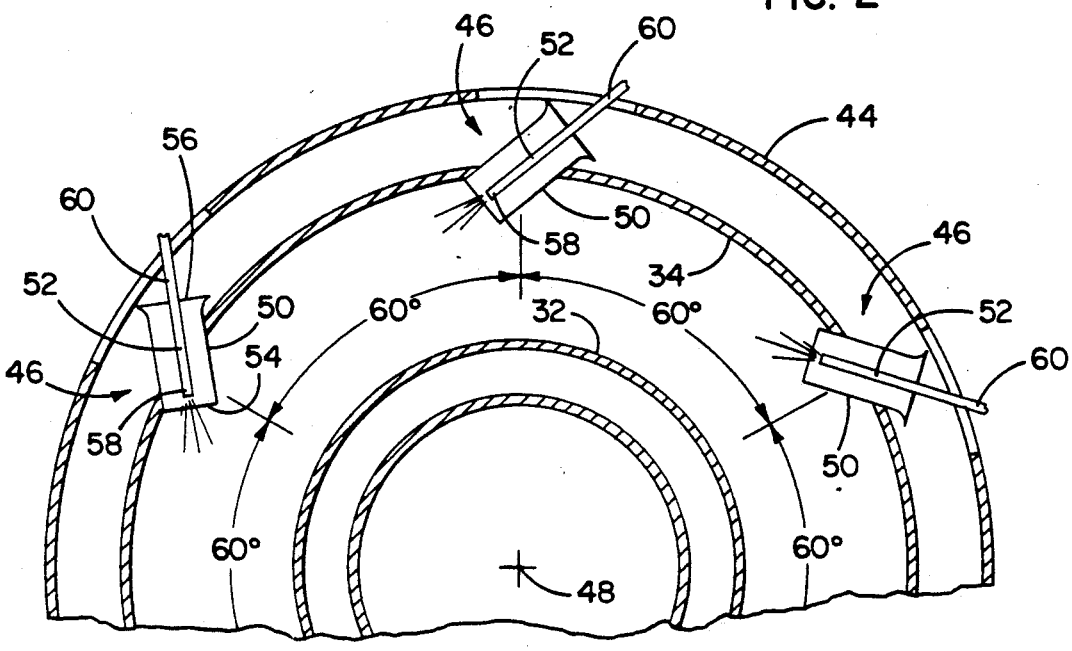

FUEL INJECTOR FOR A GAS TURBINE ENGINE

CROSS-REFERENCE

This application is a continuation-in-part of copending, commonly assigned application Ser. No. 379,548, filed Jul. 13, 1989, entitled "Turbine Engine With Pin Injector", now U.S. Pat. No. 5,063,745 issued Nov. 12, 1991.

FIELD OF THE INVENTION

This invention relates to gas turbine engines, and more particularly, to fuel injectors for use in such engines which provide a high degree of atomization and which may be manufactured at low cost.

Gas turbine engines include fuel injectors that are used to sustain turbine operation under a variety of operating conditions. In relatively small turbine engines of the type utilized in airborne environments, fuel flows at high altitudes are frequently quite low. This produces a fuel atomization problem inasmuch as typical swirl pressure atomizing start fuel injectors will not provide sufficient atomization at the low fuel flows, e.g., less than 3 pounds per hour that are required at high altitudes on the order of 50,000 feet. In high altitude ignition in gas turbine engines, combustor volume must also be maximized, i.e., made available for combustion, to provide sufficient time for reaction. Moreover, the high fuel viscosity encountered in cold, high altitude conditions adds further difficulty to achieving reliable operation.

While ignition can be obtained relatively easily at low speed conditions on the order of no more than 10 percent of maximum engine speed, kinetic loading increases significantly with engine acceleration. Under such conditions, flameout may occur, particularly at higher speeds, so it is most important to avoid local overfueling typical of the conventional injector of the swirl pressure atomizing type. In particular, the resulting fuel maldistribution renders kinetic loading an even more significant problem. Moreover, it is most important for the main fuel injectors to provide exceptionally good fuel atomization, even at low speeds, so that fuel evaporation problems do not further compound operational difficulties.

In the previously identified co-pending application, there is disclosed an injector that provides atomization based on the impingement of fuel against the surface. Problems with spray angle collapse and angle variation at low fuel flows that accompany the use of pressure atomizing swirl injectors are avoided. Moreover, the number of orifices involved in a given system may be reduced by the factor of six or even more. This allows larger orifices to be used and with fewer and larger orifices, the problems of injector plugging as a result of contamination is much reduced.

The present invention is directed to overcoming one or more of the above problems and improving on the injector disclosed in the co-pending application

SUMMARY OF THE INVENTION

It is the principal object of the invention to provide a new and improved fuel injector for a gas turbine engine. More specifically, it is an object of the invention to provide such a fuel injector which is of the impingement atomizing type.

An exemplary embodiment of the invention achieves the foregoing object in a fuel injector for a gas turbine engine which includes a means defining an elongated, smooth orifice terminating in an exit opening transverse to the axis of the orifice along with a pin mounted coaxially with the orifice in spaced relation to the exit opening. The pin has a planar end facing the exit opening, which end is parallel to the aforementioned axis.

In a preferred embodiment, the fuel injector orifice is cylindrical and the pin is also cylindrical.

In one embodiment, the fuel injector is disposed in an air blast tube for a combustor.

The invention contemplates that the end of the pin be spaced from the exit opening a distance on the order of the diameter of the orifice.

In a highly preferred embodiment, the diameters of the orifice and the pin are substantially equal.

The invention also contemplates a gas turbine engine which includes a rotary compressor, a turbine wheel coupled to the compressor to drive the same and an annular combustor disposed about the turbine wheel for receiving compressed air from the compressor and fuel from a source and combusting the same to provide gases of combustion to drive the turbine wheel.

A plurality of air blast tubes enter the combustor in a generally tangential direction and are in fluid communication with the compressor while fuel injectors of the type just described are disposed in at least some of the air blast tubes.

In a preferred embodiment, the orifice is uniformly sized and shaped to be free of burrs or similar disturbances so fuel will emerge from the exit opening as a straight jet and not as a diffusing jet.

A support is provided for the impingement surface or pin and mounts the same at the desired spacing. The support is in substantially non-interfering relation to the spray of fuel generated by impingement of the straight jet upon the impingement surface.

In one embodiment, the orifice is defined by the swaged end of a tube.

The invention also contemplates that the support extend from behind the impingement surface to one side thereof in spaced relation thereto and be connected to such tube.

Other objects and advantages will become apparent from the following specification taken in connection with the accompanying drawings.

DESCRIPTION OF THE DRAWINGS

FIG. 1 is a somewhat schematic sectional view of a gas turbine engine made according to the invention;

FIG. 2 is an enlarged, fragmentary sectional view taken approximately along the line 2—2 in FIG. 1.

DESCRIPTION OF THE PREFERRED EMBODIMENTS

Figure 3:
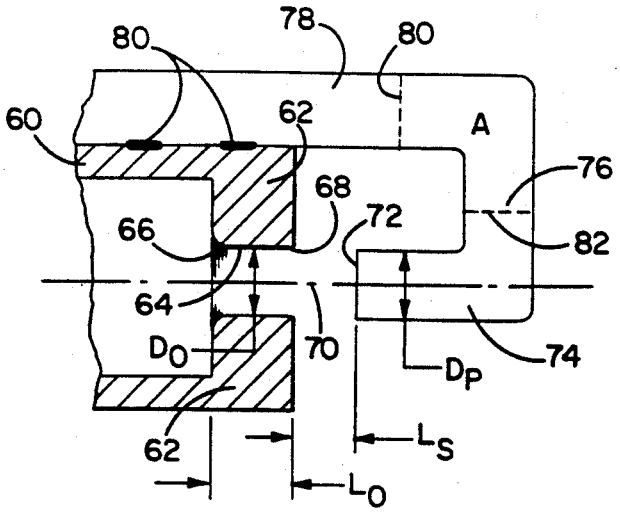
FIGS. 3–6, inclusive, are fragmentary, sectional views of fuel injectors made according to the invention.

An exemplary embodiment of a gas turbine engine made according to the invention is illustrated in the drawings in the form of a radial flow, air breathing gas turbine. However, the invention is not limited to radial flow turbines, nor even to turbines employing annular combustors as is also illustrated in the drawings.

The turbine includes a rotary shaft 10 journaled by bearings not shown. Adjacent one end of the shaft 10 is an inlet area 12. The shaft 10 mounts a rotor, generally designated 14, which may be of conventional construction. Accordingly, the same includes a plurality of compressor blades 16 adjacent the inlet 12. A compressor blade shroud 18 is provided in adjacency thereto and just radially outwardly of the radially outer extremities of the compressor blades 18 is a conventional diffuser 20.

Oppositely of the compressor blades 16, the rotor 14 has a plurality of turbine blades 22. Just radially outwardly of the turbine blades 22 is an annular nozzle 24 which is adapted to receive hot gases of combustion from an annular combustor, generally designated 26. The compressor system including the blades 16, shroud 18 and diffuser 20 delivers compressed air to the annular combustor 26, and via dilution air passages 27, to the nozzle 24 along with the gases of combustion. That is to say, hot gases of combustion from the combustor 26 are directed via the nozzle 24 against the blades 22 to cause rotation of the rotor 14, and thus the shaft 10. The latter may be, of course, coupled to some sort of apparatus for the performance of useful work. Alternatively, only a small part of the energy may be taken from the gases of combustion by the turbine blades 22 and the remainder of the energy employed to perform work as a result of thrust provided by the engine.

A turbine shroud 28 is interfitted with the combustor 26 to close off the flow path from the nozzle 24 and confine the expanding gas to the area of the turbine blades 22.

The combustor 26 has a generally cylindrical inner wall 32, and a generally cylindrical outer wall 34. The two are concentric and merge to a necked down area 36 which serves as an outlet from an interior annulus 38 of the combustor 26 to the nozzle 24. A third wall 39, generally concentric with the walls 32 and 34, extends generally radially to interconnect the walls 32 and 34 and to further define the annulus 38.

Opposite of the outlet 36 and adjacent the wall 39, the interior annulus 38 of the combustor 26 includes a primary combustion zone 40 in which the burning of fuel primarily occurs. Other combustion may, in some instances, occur downstream from the primary combustion area 40 in the direction of the outlet 36. As mentioned earlier, provision may be made for the injection of dilution air through the passages 27 to the combustor 26 downstream of the primary combustion zone 40 to cool the gases of combustion to a temperature suitable for application to the turbine blades 22 via the nozzle 24. In any event, it will be seen that the primary combustion zone 40 is an annulus or annular space defined by the radially inner wall 32, the radially outer wall 34 and the wall 39.

A further wall 44 is generally concentric to the walls 32 and 34 and is located radially outward of the latter. The wall 44 extends to the outlet of the diffuser and thus serves to contain and direct compressed air from the compressor system to the combustor 26. Mounted on the wall 44 are air and fuel injector assemblies, generally designated 46. As seen in FIG. 2, the assemblies 46 are equally angularly spaced about an axis 48, which is the rotational axis of the rotor 14 and the axis about which the combustor 26 is centered. In the illustrated embodiment, six of the assemblies 46 are employed and thus the same will be on 60° centers.

As perhaps best seen in FIG. 2, each of the assemblies 46 is made up of an air blast tube 50 with an interior fuel injector 52. The air blast tubes 50 have radially inner open ends 54 within the annulus 38 and radially outer open ends 56 within the space between the walls 34 and 44 so as to be in fluid communication with the diffuser 20 and thus receive compressed air from the compressor blades 16. It is to be specifically observed that the tubes 50 are directed generally tangentially to the annulus 38.

The fuel injectors 52 include innermost injection ends 58 on fuel conduits 60 which extend to a suitable manifold (not shown). The injection ends 58 may take on any of a variety of forms such as are illustrated in FIGS. 3–6, inclusive. With reference to FIG. 3, the conduit 60 terminates in a closed end wall 62. Centrally of the end wall 62 is a bore 64. The bore 64 includes a rounded entrance end 66 and a squared off exit opening 68. The bore 64 is somewhat elongated, smooth, straight, and lacking any burrs or other similar disturbances so that a straight, non-diffusing jet of fuel will emanate from the exit end 68. In a preferred embodiment, the bore 64 will be cylindrical and have a diameter of $D_o$, which typically will be in the range of about 0.010 to 0.015 inches for a relatively small turbine engine. The straight line length of the orifice is $L_o$ and $L_o$ should be at least equal to or greater than $D_o$.

As a result of this structure, a straight jet (as opposed to a diverging jet) of fuel will leave the exit opening 68 on the centerline 70 of the orifice 64.

Facing the exit opening, but spaced therefrom by a distance of $L_s$ is the planar end 72 of a cylindrical pin 74. The cylindrical axis of the orifice 64 and the pin 74 coincide, which is to say the two are coaxial. In addition, the diameter of the pin $D_p$ is on the same order as the diameter of the orifice $D_o$ and generally the two will be substantially equal. Importantly, whether a cylindrical shape be used for the orifice 64 and pin 74 or not, both should have the same cross sectional shape which is to say their shapes should be similar in the geometrical sense.

Furthermore, the exit opening 68 defines a plane that is transverse to the centerline or axis 70 while the flat or planar surface 72 is likewise transverse to the axis 70 which is to say it is also parallel to the plane of the exit opening 68. To obtain a good spray pattern, it is important that the surface 72 be planar and not concave or convex, free of burrs or other discontinuities and parallel to the plane of the exit opening 68 as well as concentric therewith.

Behind the surface 72, the pin 74 may be bent radially as at 76 and then returned as at 78 to be secured as by welds 80 or braze metal to the conduit or tube 60.

As mentioned previously, the surface 72 is spaced by a distance $L_s$ from the exit opening 68 In the usual case, the distance $L_s$ will be on the same order as the diameter $D_o$ of the orifice 68.

Variations in the pin diameter $D_p$ or the spacing $L_s$ are contemplated by the invention and dictate the cone angle of the resulting spray. For example, if the spacing $L_s$ is reduced or the pin diameter $D_p$ increased in relation to the orifice diameter $D_o$, a shallower spray cone will be generated from the jet of fuel impinging on the surface 72. If lesser divergence of fuel is required, the space $L_s$ may be increased or the diameter of $D_p$ of the pin 74 reduced in relation to the orifice diameter $D_o$.

It will be noted that the impingement surface 72 is supported from its side opposite the orifice 64. This feature of the invention serves to minimize the interruption of the full circumference of the spray cone by the support element. Further minimization may be achieved by narrowing the support in the area A between two dotted lines 80 and 82. This area may be narrowed as much as possible so long as structural integrity in the support of the pin 74 is maintained.

Figure 4:
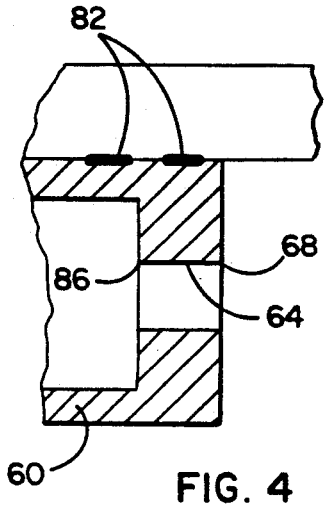

FIG. 4 illustrates an embodiment quite similar to that described in connection with FIG. 3. The only difference is that the entrance 86 is squared off rather than rounded as at 66 in FIG. 3.

Figure 5:
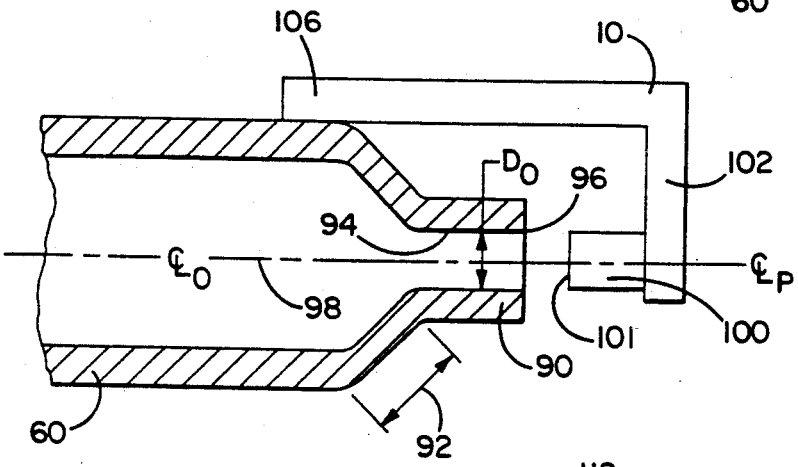

FIG. 5 illustrates a preferred form of the invention In FIG. 5, the tube 60 has an end 90 swaged as in the area 92 down to a reduced diameter to define an elongated orifice 94 that is smooth, straight, elongated and free of burrs or other disturbances, and which likewise terminates in an exit opening 96 defining a plane transverse to the centerline 98 of the orifice 94 which, again, preferably is cylindrical and has a diameter of $D_o$. In the embodiment illustrated in FIG. 5, a pin 100 having a planar end 101 is mounted on one leg 102 of an L-shaped element 104 so as to be in the same relation to the orifice 94 as the pin 74 is to the orifice 64. The other leg 106 of the L-shaped element 104 may be suitably secured to the tube 60. The same may be thinned as required.

Figure 6:
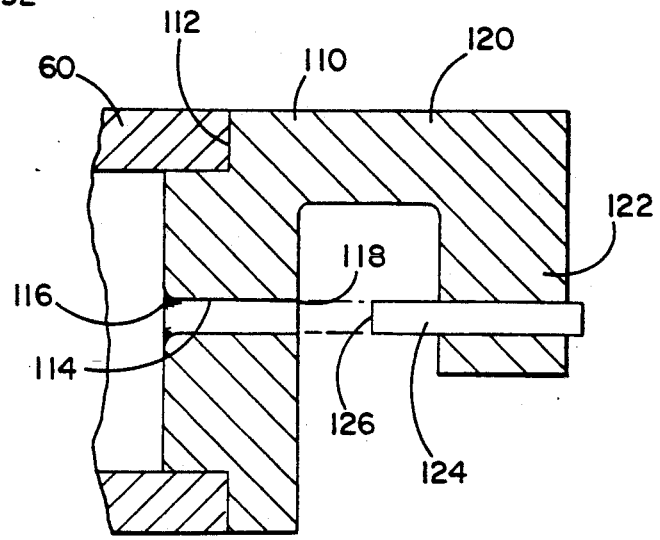

Still another embodiment is illustrated in FIG. 6. In this embodiment, an integral orifice and support element 110 is mounted in the end of tube 60 through receipt of the tube end in a stepped recess 112 extending around the element 110. Centrally disposed within the element 110 is a cylindrical bore 114 having a rounded entrance 116 and a planar exit opening 118 which again is transverse to the cylindrical axis of the bore 114. The bore 114 again is elongated, smooth, straight and free of burrs or other disturbances that would cause a jet of fuel emanating from the exit 118 to be a diverging jet.

The element 110 includes an integral L-shaped structure 120 having a leg 122 which mounts a pin 124 having a planar end 126 which is transverse to the cylindrical axis of the bore 114. Again, the L-shaped element 120 may be relieved as necessary to minimize interruption of the conical spray of fuel.

The impingement surfaces are disposed within their respective tubes 50 such that the resulting cone of fuel does not impact the interior wall of the associated tube 50. Ideally, the cone of fuel will pass closely by the radially inner end 54 of the corresponding tube 50 without actually contacting the same. To achieve good positioning, the location of the injector 52 should be chosen for a worst case operating regimen. For example, in a typical engine, air velocity through the tubes 50, which is proportional to the cranking speed of the engine, may be as low as 40 feet per second on a cold day because of high drag and low starting power if a battery operated starting motor is utilized. Consequently, the positioning of the impingement injector within the throat of the air blast tube 50 can best be ascertained with reference to the worst case cold operating or starting environment.

From the foregoing, it will be appreciated that fuel injectors made according to the invention can be made relatively inexpensively and further, are more reliable than swirl type pressure atomization injectors. Extremely good atomization may be achieved at low fuel flow rates and because the total number of orifices in any given system is considerably reduced, larger orifices may be employed which in turn minimizes the problem of clogging due to fuel contamination.

We claim:

1. A low cost fuel injector for use in a gas turbine engine having a combustor comprising:

a conduit terminating in an injection orifice disposed in the combustor of a gas turbine engine, said orifice having an entrance and an exit with a straight line length equal to or greater than its diameter and being uniformly sized and shaped to be free of burrs or similar disturbances to define means for causing to define means for causing fuel to emerge from said exit as a straight jet and not as a diffusing jet;

an impingement surface mounted in proximity to said exit, said impingement surface having a shape that is similar in the geometric sense to the shape of said orifice and of substantially the same size as said orifice and being coaxial therewith, said surface being planar and parallel to a plane defined by said exit;

a support for said surface and mounting the same a distance from said axis on the same order as said diameter, said support being located behind said surface and in substantially non-interfering relation to a spray of fuel generated by impingement of said straight jet upon said surface; and an air blast tube about said conduit and so located with respect thereto and to said impingement surface such that a said spray of fuel will pass closely to an end of said air blast tube without contacting the same.

2. The fuel injector of claim 1 wherein said conduit is a tube and said orifice is defined by a swaged end of said tube.

3. The fuel injector of claim 1 wherein said support extends from behind said surface to one side thereof in spaced relation thereto and is connected to said conduit.

4. The fuel injector of claim 1 wherein said surface is defined by the end of a pin.

5. The fuel injector of claim 4 wherein said pin is cylindrical.

6. A fuel injector for a gas turbine engine comprising:

means defining an elongated smooth, cylindrical orifice terminating in an exit opening transverse to the cylindrical axis of said orifice for causing fuel to emerge from said exit opening generally as a straight, non-diffusing jet and connected to a source of fuel under pressure;

a cylindrical pin mounted coaxially with said orifice in spaced relation to said exit opening, said pin having a planar end facing said exit opening, said end being parallel to said cylindrical axis;

said fuel injector being disposed in an air blast tube for a combustor;

said fuel injector being located in said air blast tube to cause a spray of fuel to pass closely to an end thereof without contacting said tube.

7. The fuel injector of claim 6 wherein said pin end is spaced from said exit opening a distance on the order of the diameter of said cylindrical orifice.

8. The fuel injector of claim 7 wherein the diameters of said orifice and said pin are substantially equal.

9. The fuel injector of claim 6 wherein the diameters of said orifice and said pin are substantially equal.

10. A gas turbine engine including:

a rotary compressor;

a turbine wheel coupled to said compressor to drive the same;

an annular combustor disposed about said turbine wheel from a source and combusting the same to provide gases of combustion to drive said turbine wheel;

a plurality of air blast tubes entering said combustor in a generally tangential direction and in fluid communication with said compressor;

fuel injectors in at least some of said tubes, each said fuel injector including means defining an elongated, smooth, cylindrical orifice terminating in an exit opening transverse to the cylindrical axis of said orifice for generating a straight jet of fuel, said fuel injectors being located in their respective air blast tubes to cause a spray of fuel to pass closely to an end thereof without contacting the associated tube; and a cylindrical pin mounted coaxially with said orifice in spaced relation to said exit opening, said pin having a planar end facing said exit opening, said end being parallel to said cylindrical axis.

* * * * *